US008316505B2

(12) United States Patent
Chow

(10) Patent No.: US 8,316,505 B2
(45) Date of Patent: Nov. 27, 2012

(54) STEAM CLEANER

(75) Inventor: Oscar Chow, Zhongshan (CN)

(73) Assignee: Xiotin Industry Co., Ltd., Zhongshan (CN)

( * ) Notice: Subject to any disclaimer, the term of this patent is extended or adjusted under 35 U.S.C. 154(b) by 0 days.

(21) Appl. No.: 13/188,259

(22) Filed: Jul. 21, 2011

(65) Prior Publication Data

US 2012/0216365 A1 Aug. 30, 2012

(30) Foreign Application Priority Data

Feb. 28, 2011 (CN) ..... 2011 2 0050364 U

(51) Int. Cl.
*A47L 7/00* (2006.01)

(52) U.S. Cl. ..... 15/320; 15/98; 15/322; 15/367; 15/403

(58) Field of Classification Search ..... 15/320, 15/322, 367, 403, 98; *A47L 7/00*
See application file for complete search history.

(56) References Cited

U.S. PATENT DOCUMENTS 6,895,626 B2 5/2005 Tsai
7,380,307 B2 * 6/2008 Tsai ..... 15/320
7,555,814 B2 7/2009 Lee et al.
7,665,180 B2 * 2/2010 Haan ..... 15/320
7,930,798 B2 * 4/2011 Zhou et al. ..... 15/320
8,171,592 B2 5/2012 Tsai

OTHER PUBLICATIONS

Co-pending U.S. Appl. No. 13/189,088, filed Jul. 22, 2011.

* cited by examiner

*Primary Examiner* — David Redding
(74) *Attorney, Agent, or Firm* — Hamre, Schumann, Mueller & Larson, P.C.

(57) ABSTRACT

A steam cleaner capable of automatically absorbing dust includes a main body; a handle arranged at an upper end of the main body; and a cleaning towel arranged at a bottom of the main body. The main body is provided with a shell, an inner cavity of the shell is provided with a steam generating device, and the inner cavity of the shell is further provided with a dust absorbing device, and wherein the dust absorbing device includes a telescopic dust absorbing head, and the shell or the handle is provided with a switch for controlling the dust absorbing head to be telescopic and absorb the dust. The shell of the steam cleaner is internally provided with the dust absorbing device with the telescopic dust absorbing head; and the switch controls the dust absorbing head to be telescopic and absorb the dust. A user only needs to press or rotate the switch, so that the dust absorbing head can be automatically outwards extended to absorb the dust on the ground; and after cleaning, the user only needs to press or rotate the switch, so that the dust absorbing head can be inwards retracted, and the steam cleaning function is recovered, therefore, the steam cleaner is very convenient to be used.

7 Claims, 2 Drawing Sheets

STEAM CLEANER

TECHNICAL FIELD

The present invention relates to the field of a cleaning tool, and more particularly, to a steam cleaner capable of automatically absorbing dust.

RELATED ART

The steam cleaner converts cleaning water into high-temperature and high-pressure stem by a steam generating system, and sprays the steam to a mop cloth which is arranged at a cleaning end of the cleaner to kill various bacterium, microbes, germs and the like on a surface of a cleaned object, thereby being widely used for the sterilizing, the dedusting, the decontaminating, and the deoiling occasion and so on, and being suitable for enterprises and families. Currently, the steam cleaner is additionally provided with a dust absorbing device, and a working end of the dust absorbing device is a dust absorbing head. The functions such as the dust absorbing and the steam cleaning of a conventional product only can be switched by manually changing a component which is arranged at the bottom of the product, so that the use of the conventional steam cleaner is very inconvenient.

SUMMARY

The present patent application aims at providing a steam cleaner capable of automatically absorbing dust, and solving a problem of the inconvenient use of an existing steam cleaner capable of automatically absorbing dust.

The technical problem of the present patent application is solved by the following solutions: a steam cleaner capable of automatically absorbing dust includes a main body, a handle arranged at an upper end of the main body and a cleaning towel arranged at a bottom of the main body, wherein the main body is provided with a shell, an inner cavity of the shell is provided with a steam generating device, and the inner cavity of the shell is further provided with a dust absorbing device.

The dust absorbing device includes a telescopic dust absorbing head; and

The shell or the handle is provided with a switch which controls the dust absorbing head to be telescopic and absorb the dust.

The preferable technical scheme of the present patent application is as follows:

The dust absorbing device further includes a dust absorbing motor and a dust cup; and the dust absorbing motor is communicated with the dust cup by a filter arranged at a lower end of the dust absorbing motor.

The filter is a screen mesh.

The dust cup is communicated with the dust absorbing head by a connecting pipe.

The switch is a button or a rotary knob.

The steam generating device includes a water tank, a water pump, a heater and a nozzle; the water pump is communicated with the water tank and the heater by a water conducting pipeline and a water transporting pipeline respectively; the heater is communicated with the nozzle by a steam pipeline; and the nozzle is arranged above the cleaning towel.

The shell of the steam cleaner is internally provided with the dust absorbing device with the telescopic dust absorbing head; and the switch controls the dust absorbing head to be telescopic and absorb the dust. Once seeing the dust on the ground during cleaning the ground by steam, a user only needs to press or rotate the switch, so that the dust absorbing head can be automatically outwards extended to absorb the dust on the ground; and after cleaning, the user only needs to press or rotate the switch, so that the dust absorbing head can be inwards retracted, and the steam cleaning function is recovered, therefore, the steam cleaner is very convenient to be used.

DETAILED DESCRIPTION OF THE PREFERRED EMBODIMENTS

In order to describe the objects, the technical schemes and the advantages of the present patent application more clearly, the present patent application is further explained in detail with reference to the accompanying drawings and an embodiment. However, it is to be appreciated that the following description of the embodiment is merely exemplary in nature and is no way intended to limit the present patent application.

The present patent application provides a steam cleaner capable of automatically absorbing dust, which includes a main body, a handle arranged at an upper end of the main body and a cleaning towel arranged at a bottom of the main body, wherein the main body is provided with a shell, an inner cavity of the shell is provided with a steam generating device, and the inner cavity of the shell is further provided with a dust absorbing device. The dust absorbing device includes a telescopic dust absorbing head. The shell or the handle is provided with a switch which controls the dust absorbing head to be telescopic and absorb the dust. The detailed implement of the steam cleaner capable of automatically cleaning the floor is described in detail with reference to the accompanying embodiment.

Figure 1:
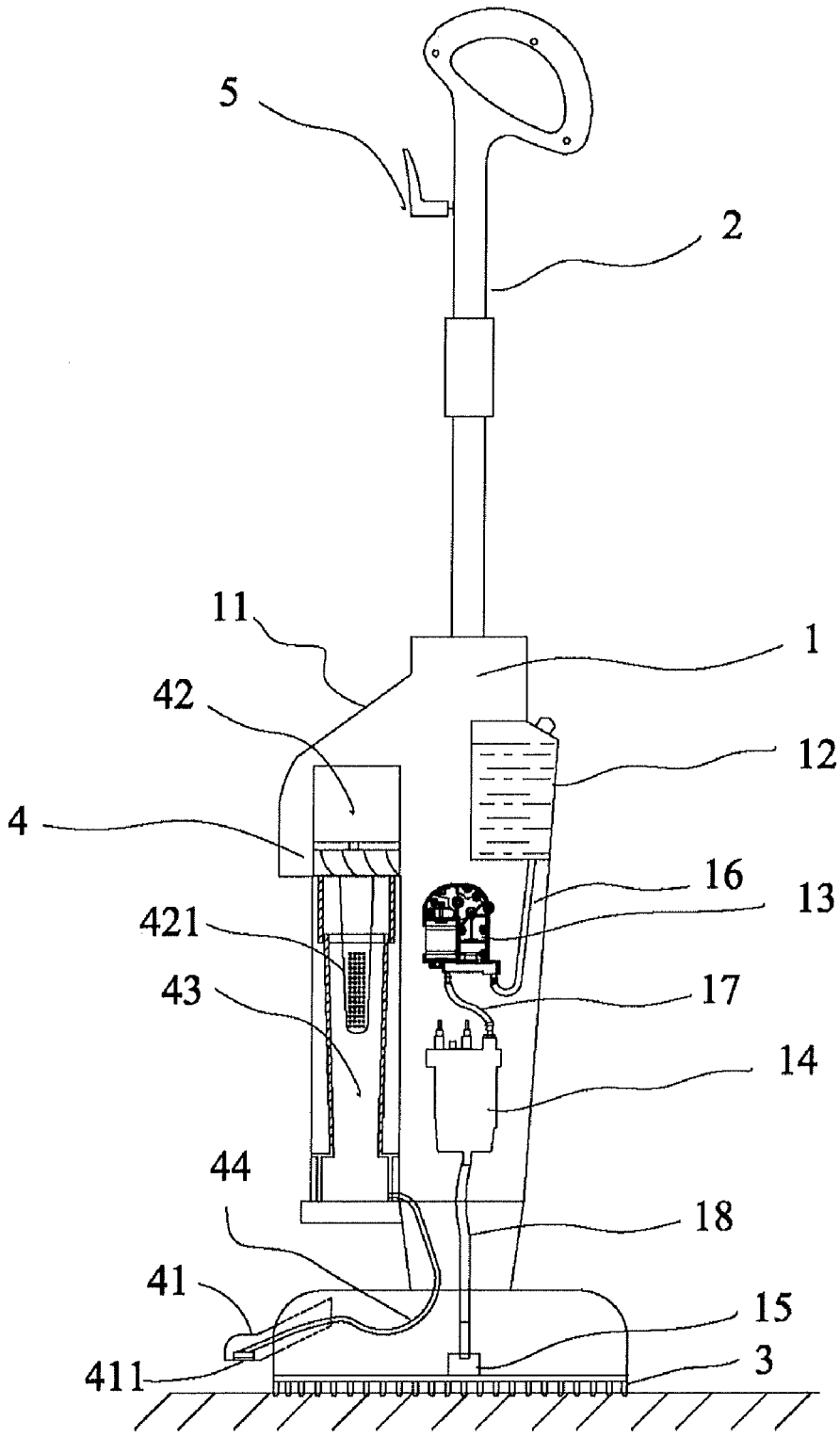
FIG. 1 is a structural view of the steam cleaner capable of automatically absorbing dust in accordance with an embodiment of the present invention.
Figure 2:
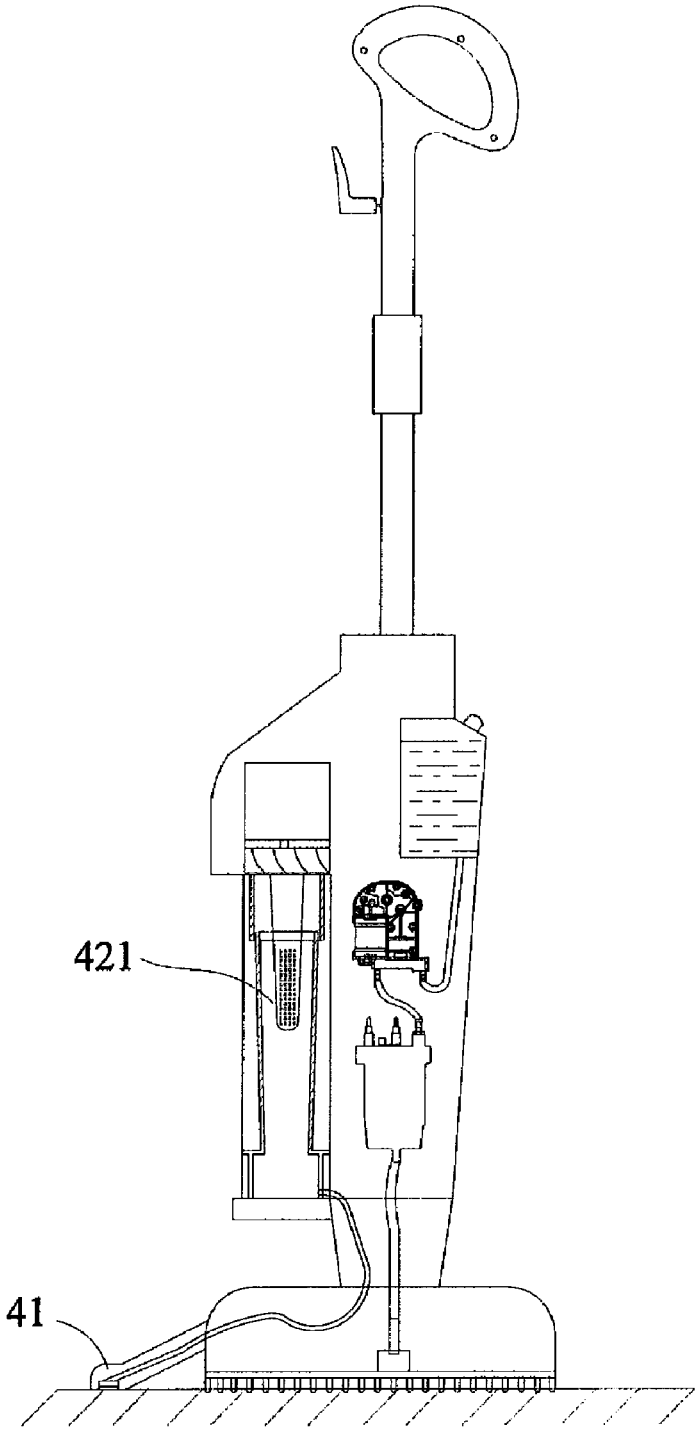
FIG. 2 is a use state view of the steam cleaner capable of automatically absorbing dust in accordance with an embodiment of the present invention.

Referring to FIG. 1 and FIG. 2, the steam cleaner capable of automatically absorbing the dust includes a main body 1, a handle 2 arranged at the upper end of the main body 1 and a cleaning towel 3 arranged at the bottom of the main body 1. The main body 1 includes a shell 11, an inner cavity of the shell is provided with a steam generating device. The steam generating device includes a water tank 12, a water pump 13, a heater 14 and a nozzle 15 arranged below the main body 1. An inlet of the water pump 13 is connected with the water tank 12 by a water conducting pipeline 16, and an outlet of the water pump 13 is connected with an inlet of the heater 14 by a water transporting pipeline 17, an outlet of the heater 14 is connected with the nozzle 15 by a steam pipeline 18, and the cleaning towel 3 is arranged below the nozzle 15. Cleaning water becomes high-pressure steam in the heater 14, and the high-pressure steam is transported to the nozzle 15 by the steam pipeline 18 and is sprayed to the cleaning towel 3 by the nozzle 15 to realize the function of cleaning the floor at high temperature.

The steam cleaner capable of automatically absorbing the dust is further provided with a dust absorbing device 4 for automatically absorbing dust. The dust absorbing device 4 is arranged in the shell 11 and is provided with a telescopic dust absorbing head 41 which is arranged below the inner portion of the shell 11, and the shell 11 or the handle 2 is provided with a switch 5 which controls the dust absorbing head 41 to be telescopic and absorb the dust. When the dust is absorbed, the switch 5 controls the dust absorbing head 41 to be extended out of the shell 11 to absorb the dust, and controls the dust absorbing head 41 to be retracted into the shell 11 after the dust is absorbed.

The shell of the steam cleaner is internally provided with the dust absorbing device with the telescopic dust absorbing head; and the switch controls the dust absorbing head to be telescopic and absorb the dust. Once seeing the dust on the ground during cleaning the ground by steam, a user only needs to press or rotate the switch, so that the dust absorbing head can be automatically outwards extended to absorb the dust on the ground; and after cleaning, the user only needs to press or rotate the switch, so that the dust absorbing head can be inwards retracted, and the steam cleaning function is recovered, therefore, the steam cleaner is very convenient to be used.

Further, referring to FIGS. 1 and 2, in this embodiment, the dust absorbing device 4 may have the structure as follows: the dust absorbing device 4 further includes a dust absorbing motor 42 and a dust cup 43 besides a dust absorbing head 41. A lower end of the dust absorbing motor 42 is provided with a filter 421 which may be a screen mesh, and the dust absorbing motor 42 is communicated with the dust cup 43 by the filter 421. The dust cup 43 is communicated with the head absorbing head 41 by a connecting pipe 44. When the dust absorbing device 4 works, the switch 5 controls the dust absorbing head 41 to be outwardly extended, an absorbing port 411 is adhered to the ground, and the dust absorbing motor 42 starts to run, so that the air in the dust cup 43 is exhausted to reduce the air pressure, and the dust on the ground is absorbed into the dust cup 43 by the dust absorbing head 41 and the connecting pipe 44. When the dust is absorbed, the switch 5 controls the dust absorbing head 41 to be retracted, and the dust absorbing motor 42 stops running, so that the dust absorption is finished.

In the embodiment, the switch 5 may be a button, and the switch 5 is pressed if the dust needs to be absorbed, so that the dust absorbing device 4 starts to work. The switch 5 is pressed again, so that the dust absorbing device 4 stops absorbing the dust. The switch 5 may be a rotary button, and the switch 5 is rotated towards the left and the right to start to absorb the dust, and is reversely rotated to stop absorbing the dust. Certainly, the switch 5 may be other type switches and not repeatedly described herein.

The present invention may be embodied in other forms without departing from the spirit or novel characteristics thereof. The embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. A steam cleaner capable of automatically absorbing dust comprising:

a main body;

a handle arranged at an upper end of the main body; and a cleaning towel arranged at a bottom of the main body, wherein the main body is provided with a shell, an inner cavity of the shell is provided with a steam generating device, and the inner cavity of the shell is further provided with a dust absorbing device, and wherein the dust absorbing device comprises a telescopic dust absorbing head, and the shell or the handle is provided with a switch for controlling the dust absorbing head to be telescopic and absorb the dust.

2. The steam cleaner as claimed in claim 1, wherein the dust absorbing device further comprises a dust absorbing motor and a dust cup, and the dust absorbing motor is communicated with the dust cup by a filter arranged at a lower end of the dust absorbing motor.

3. The steam cleaner as claimed in claim 2, wherein the filter is a screen mesh.

4. The steam cleaner as claimed in claim 2, wherein the dust cup is communicated with the dust absorbing head by a connecting pipe.

5. The steam cleaner as claimed in claim 1, wherein the switch is a button or a rotary knob.

6. The steam cleaner as claimed in claim 1, wherein the steam generating device comprises a water tank, a water pump, a heater and a nozzle; the water pump is communicated with the water tank and the heater by a water conducting pipeline and a water transporting pipeline respectively; the heater is communicated with the nozzle by a steam pipeline; and the nozzle is arranged above the cleaning towel.

7. A steam cleaner comprising:

a main body;

a handle arranged at an upper end of the main body; and a cleaning towel arranged at a bottom of the main body, wherein the main body is provided with a shell, an inner cavity of the shell is provided with a steam generating device, and the inner cavity of the shell is further provided with a dust absorbing device, and wherein the dust absorbing device comprises a telescopic dust absorbing head, and the shell or the handle is provided with a switch for controlling the dust absorbing head to be telescopic and absorb the dust; wherein the dust absorbing device further comprises a dust absorbing motor and a dust cup, and the dust absorbing motor is communicated with the dust cup by a screen mesh arranged at a lower end of the dust absorbing motor; wherein the dust cup is communicated with the dust absorbing head by a connecting pipe; wherein the steam generating device comprises a water tank, a water pump, a heater and a nozzle; the water pump is communicated with the water tank and the heater by a water conducting pipeline and a water transporting pipeline respectively; the heater is communicated with the nozzle by a steam pipeline; and the nozzle is arranged above the cleaning towel.

* * * * *